US005181528A

United States Patent [19]

Chen et al.

[11] Patent Number: 5,181,528

[45] Date of Patent: Jan. 26, 1993

[54] APPARATUS FOR EXTINGUISHING A LIGHTED CIGARETTE

[75] Inventors: Hsing Chen; Horng-Show Koo; Li Chang, all of Hsinchu; K. L. Shieh, Taipei, all of Taiwan

[73] Assignee: Industrial Technology Research Institute, Taiwan

[21] Appl. No.: 771,497

[22] Filed: Oct. 4, 1991

[51] Int. Cl.[5] ..... A24F 19/14

[52] U.S. Cl. ..... 131/256; 131/233; 131/235.1; 131/237

[58] Field of Search ..... 131/256, 329, 231, 233, 131/235.1, 237

[56] References Cited

U.S. PATENT DOCUMENTS

| | | | |
|---|---|---|---|
| 1,848,388 | 3/1932 | Seitz | 131/237 |
| 2,118,564 | 5/1938 | McCready | 131/231 |
| 2,253,473 | 8/1941 | Statelles | 131/233 |
| 2,520,746 | 8/1950 | Uman | 131/233 X |
| 2,645,229 | 7/1953 | Stillman | 131/235.1 |
| 4,027,682 | 6/1977 | Halmaghi | 131/233 |
| 4,897,033 | 1/1990 | Yang | 131/233 X |

*Primary Examiner*—Vincent Millin

*Assistant Examiner*—J. Doyle

*Attorney, Agent, or Firm*—Scully, Scott, Murphy & Presser

[57] ABSTRACT

An apparatus for extinguishing a lighted cigarette comprises a hollow external seat and a storing container. A blade for cutting and extinguishing the burning portion of a lighted cigarette in combination with an L-shaped plate are provided within a seat. Both the plates are made from shape memory alloys having different temperature reaction gradients. When the burning portion of a cigarette is placed into the seat and comes into contact with the blade, the plate will restore to its memory shape by the temperature response in cutting off the lighted portion of the cigarette and extinguishing the lighted portion by pressing it on the L-shaped plate. The L-shaped plate stretches straight to let the cigarette ash drop into the storing container. When the temperature of the L-shaped plate is decreased, the plate recovers to its original position to cover the storing container. The cigarette ash is thus restricted within the storing container to prevent it from dispersing and causing pollution. A lighter is detachably inserted into the apparatus and facilitates carrying and provides a safe and clean environment.

8 Claims, 6 Drawing Sheets

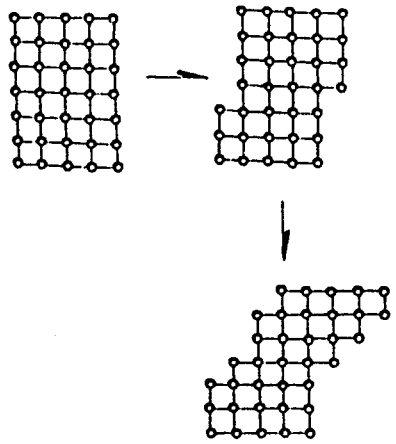
Fig. 5 (a)
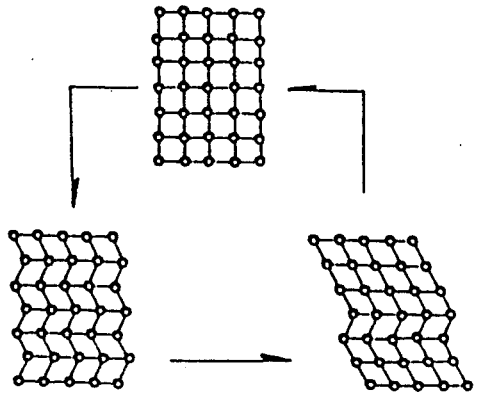
Fig. 5 (b)
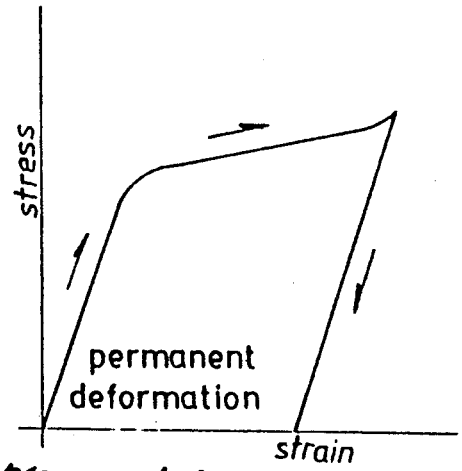
Fig. 6 (a) Common Metal
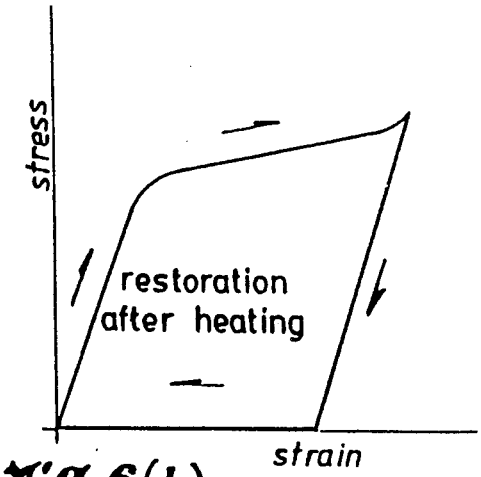
Fig. 6 (b) Shape Memory Alloy

APPARATUS FOR EXTINGUISHING A LIGHTED CIGARETTE

BACKGROUND OF THE INVENTION

The present invention relates to an apparatus for extinguishing a lighted cigarette, in particular, for cutting-off the lighted part of the cigarette, extinguishing the cut-off portion of the cigarette and then storing the ash of the cigarette within a storing chamber.

It is very often that cigarette butts, either lighted or unlighted, can be found everywhere in the streets, on the fields, in the drains and at public squares. Occasionally, these lighted cigarette butts may cause hazards such as fire, and may destroy thousands of lives, damage property and also destroy the natural ecology. Although ash-tray and cigarette butt collecting containers are provided at those public spots or in the office, it is not possible to fully prevent the ashes of the cigarettes from dispersing here and there. If a strong gust of wind blows over these containers, a very unpleasant scene will occur. In most homes where ash-trays are provided in the living room, the unpleasant odor of cigarettes may sometimes occupy the whole atmosphere of the hall if the ashes and/or the cigarette butts are not properly disposed of.

Taiwanese Patent No. 116679 entitled "A LIGHTER HAVING AN ATTACHED EXTINGUISHING MEANS", published in Jan. 25, 1989, discloses a lighter having a flame extinguishing means. However, numerous drawbacks are found which need to be overcome:

1. The extinguished portion of the cigarette is caught at the tongue of the extinguishing means, and if a second lighted cigarette is to be extinguished, the ash of the cigarette butt will be dispersed everywhere and will cause further littering of the environment.
2. The ashes of the cigarette must be cleared away from the extinguishing means prior to further use of extinguishing means.
3. As the extinguishing means is mounted on a conventional lighter, the capacity for liquified petroleum gas has to be reduced to at least ¼ of the original capacity. Sometimes, the shape of the lighter may have to be redesigned in order to accommodate the extinguishing means.

SUMMARY OF THE INVENTION

Accordingly, it is an object of the present invention to provide an apparatus for extinguishing a lighted cigarette comprising a hollow external seat and a collecting box for cigarette butts. An extinguishing means is mounted within the interior of the external seat so as to extinguish the lighted flame and then cut-off the lighted cigarette butt.

It is another object of the present invention to provide an apparatus for extinguishing a lighted cigarette, wherein the extinguishing means makes use of the temperature effect of two pieces of shape memory alloy having different temperature reaction gradients to produce an automatic cutting off and extinguishing of the lighted portion of the cigarette, and then storing of the cigarette ash within a chamber/container. Thus the cigarette butt and the ash can be safely handled.

BRIEF DESCRIPTION OF THE DRAWINGS

The present invention will be further explained with reference to the annexed drawings, wherein

FIGS. 5*a* and 5*b* are a comparison drawing showing the changing of shape mechanism of common metal and memory alloy.

FIGS. 6*a* and 6*b* are a comparison drawing showing the strain and stress of common metal and memory alloy.

DETAILED DESCRIPTION OF THE INVENTION

While this specification concludes with claims particularly pointing out and distinctly claiming that which is considered to be the invention, it is believed that the invention can be better understood from a reading of the following detailed description of the invention.

Figure 1:
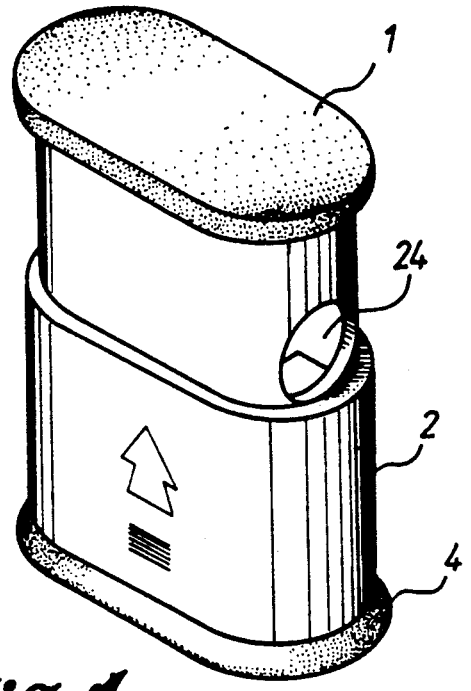
FIG. 1 is a perspective view of an apparatus for extinguishing a lighted cigarette in accordance with the present invention.
Figure 2:
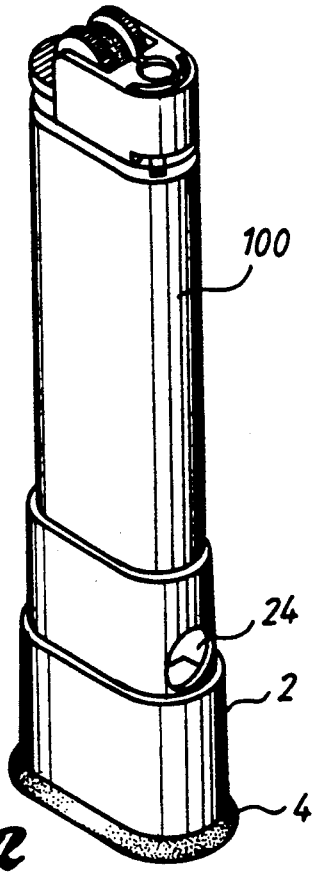
FIG. 2 is a perspective view of an apparatus for extinguishing a lighted cigarette in accordance with the present invention in combination with a cigarette lighter.

Referring to FIG. 1, there is shown an apparatus for extinguishing a lighted cigarette which essentially comprises a substantially cylindrical hollow external seat 2, a storing chamber 3 mounted into the hollow space of the seat 2 at the center thereof, the bottom of the seat 2 being detachably mounted with a bottom cover 4 and the top of the external seat 2 being closed with a top cover 1. When the bottom cover 4 is removed, the storing container 3 (FIG. 3) can be detached for cleaning and/or replacement. As shown in FIG. 2, when the top cover 1 is removed, the seat 2 can be used to accommodate a lighter 100 which is commonly found in the market. The other words, the common type of lighter can be mounted to the extinguishing means without changing the design or the structure of the lighter.

Figure 3A:
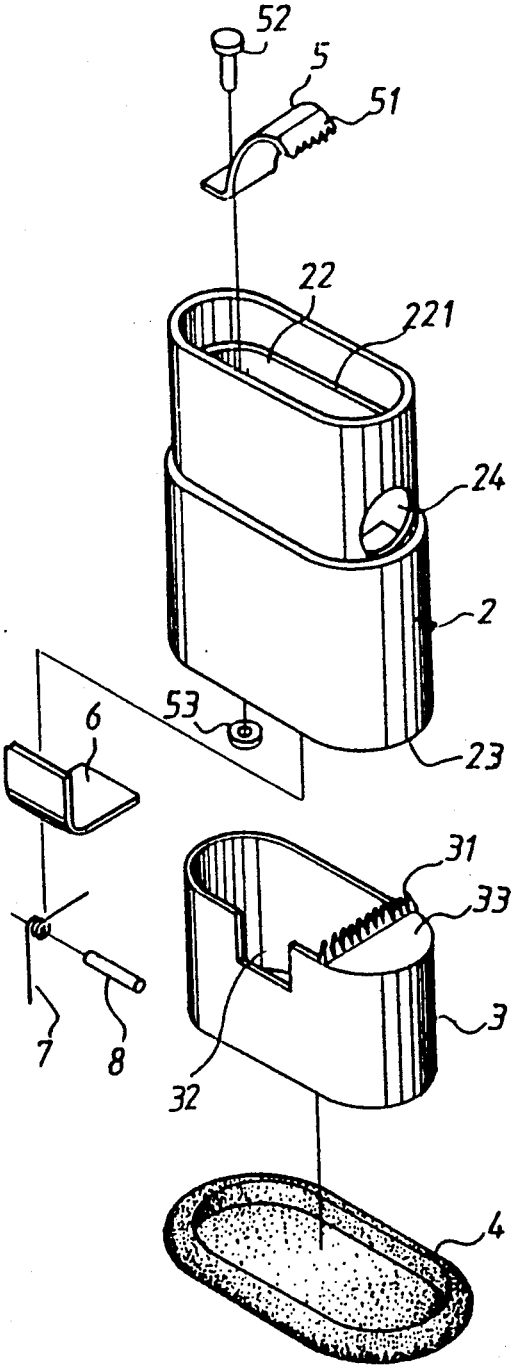
FIGS. 3*a* and 3*b* are an exploded perspective view of an apparatus for extinguishing a lighted cigarette in accordance with the present invention.
Figure 3B:
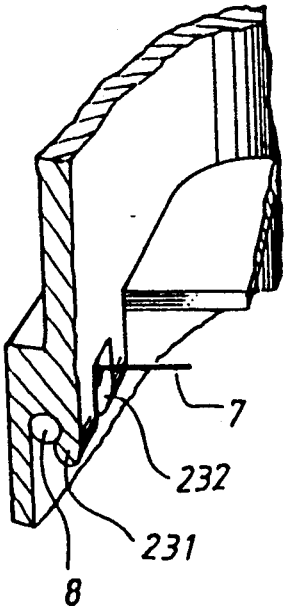
Figure 7:
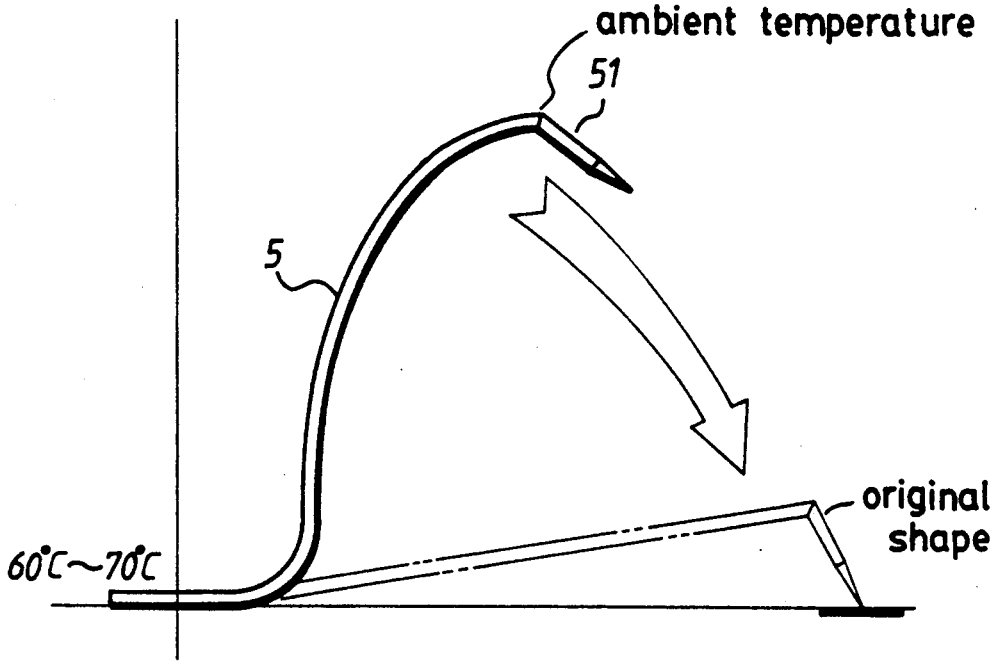
FIG. 7 is a schematic view illustrating the temperature setting of SMA of the temperature sensing blade.

Referring in FIGS. 1 and 3, a cigarette insertion hole 24 having a diameter slightly larger than that of a cigarette is provided at one lateral side of the hollow external seat 2. By means of a horizontal partitioning wall 21, the interior space of the hollow external seat 2 is partitioned into an upper blocking chamber 22 and a lower storing chamber 23, wherein the interior wall of the upper blocking chamber 22 is provided with an engaging edge 221 therearound for the positioning of a lighter inserted therein. There is a communicating path 211 (FIG. 9) between the blocking chamber 22 and the storing chamber 23. A temperature sensing blade 5, which is made from Shape Memory Alloy, is provided at the upper surface of the partitioning plate 21 (FIG. 7). The blade 5 is processed to have a memory of an arch-shape. One end of the blade 5 is mounted to the partitioning plate 21 with a screw 52 and nut 53. The other end of the blade 5 is raised upward to form an arch-shape and the edge thereof is soldered by Laser soldering with an alloy material. The edge has a sawtooth-like structure 51 so as to cut the lighted portion of a cigarette when it is inserted via hole 24. At the interior lateral wall of the blocking chamber 22, a temperature sensing plate 6 (FIG. 10) is provided. This temperature sensing plate 6 is made from shape memory alloy and has been processed to have a memory of an L-shape. One end of the plate 6 has a dimension sufficient to be used to cover the communicating path 211 of the storing chamber 23 to the blocking chamber 22 such that the storage container 3 is sealed and the ash of the cigarette will not disperse everywhere. The bottom portion of the sensing plate 6 urges a spring 7 to guarantee the sealing of the storing chamber 23.

Figure 4:
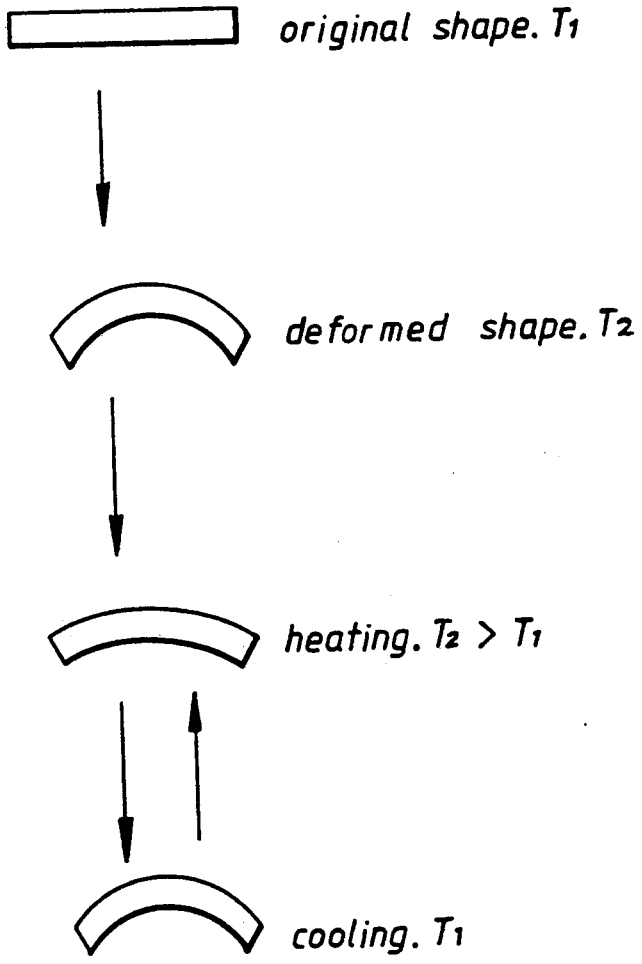
FIG. 4 is a schematic view showing the properties of a Shape Memory Alloy.

Referring to FIGS. 3 and 4 by making use of temperature and critical stress of the memory alloys, the temperature sensing blade 5 and the temperature sensing plate 6 are first set to form into shape memory alloy of different temperature reaction gradients. As shown in FIG. 4, the shape memory alloy is a special alloy which has the ability to restore to its original shape by heating after it has been distorted or deformed.

Common metals can undergo plastic deformation. This is due to the dislocation of different rows (which has been shown in FIG. 5(*a*)). As a result, when a common metal is deformed and then heated, the metal will not be restored to its original shape. On the other hand, for a shape memory alloy, it can be restored to its original shape. This is due to the reversibility of the martensite phase of the alloy. If the temperature of the material is lowered or the material is exerted on by an external stress, the martensite phase will grow. If the temperature is increased or the externally exerted stress of the material is lowered, the martensite phase will contract. Finally, the shape of the whole structure changes to the martensite parent phase. As shown in FIG. 5(*b*), due to the fact that the growth and contraction of the martensite phase is along a similar path and the continuous procedure of growth is reversible, thus it possesses the shape memory effect.

Referring to FIG. 6, in view of the properties obtained during the tensile test on the behavior of plastic deformation and shape memory, at the test condition where the test temperature is lower than the transition temperature of the martensite phase, if the externally applied force exceeds the elastic limit, the coordination of the plate-like martensite phase will rearrange, such that the tensile curve appears to be similar to the plastic deformation. If the external force is removed, the obtained tensile behavior is similar to that of the general metal and a plastic deformation is left. In view of the shape memory alloy, the deformation of the alloy can be fully restored by elevating the temperature of the plate to cause the martensite phase to change to the original parent phase. (This has been shown in FIG. 6(*b*). But for the general type of metal, deformation cannot be restored.

Figure 8:
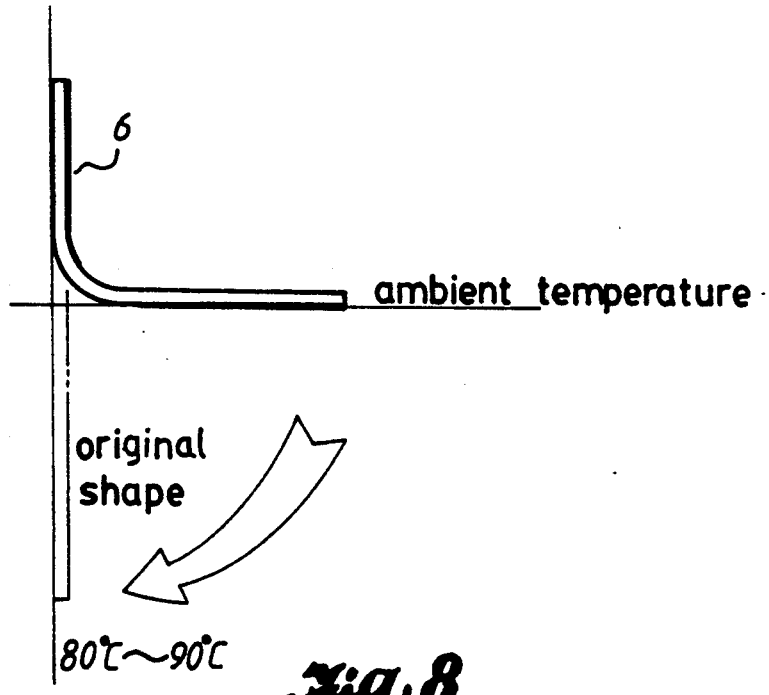
FIG. 8 is a schematic view illustrating the temperature setting of SMA of the temperature sensing plate.

Referring to FIGS. 7 and 8, which show the setting of critical stress and the temperature of the shape memory alloy of the temperature sensing blade 5 and temperature sensing plate 6, such that the transition temperature of the sensing blade 5 is set at 60° to 70° C. and that of sensing plate 6 is set at 80° to 90° C. When the temperature of the sensing blade 5 is at 60° to 70° C., the shape thereof is restored, as shown in FIG. 7. That is, the blade 5 extends to become straight. At this moment, the arch-shaped plate 6 is rapidly bent downward. Similarly, when the temperature of the sensing plate 6 is at 80° to 90° C., the shape thereof is restored and becomes straight which is shown in FIG. 8.

Referring to FIG. 3(*b*), at the lower section of the storing chamber 23 within the hollow external seat 2 and at the same side as the sensing plate 6, a pair of symmetrical downward bending seats 231 are provided. An arch-shaped fastening slot 232 is formed by the seat 231 and the inner lateral edge thereof. By means of a peg 8, the spring 7 is mounted in between the two seats 231. One end of the spring 7 urges the inner edge of the storing chamber 23 and the other end of the spring 7 is mounted to the bottom of the sensing plate 6. The storing chamber 23 can be provided with a storing container 3 being sealed at the bottom end thereof. Corresponding to the seat 231 and at the same lateral side of the seat 231, a notch 32 is provided such that the storing container 3 can be engaged with the storing chamber 23. The upper end of the storing chamber 3 at one lateral side forms a horizontal plate 33 having a sawtooth-like structure. This sawtooth-like structure 31 corresponds to the upper sawtooth-like structure 51 of the sensing blade 5. By means of the combination of the blade 5 and the sawtooth-like structure 31, the lighted portion of a cigarette can be cut.

Figure 9:
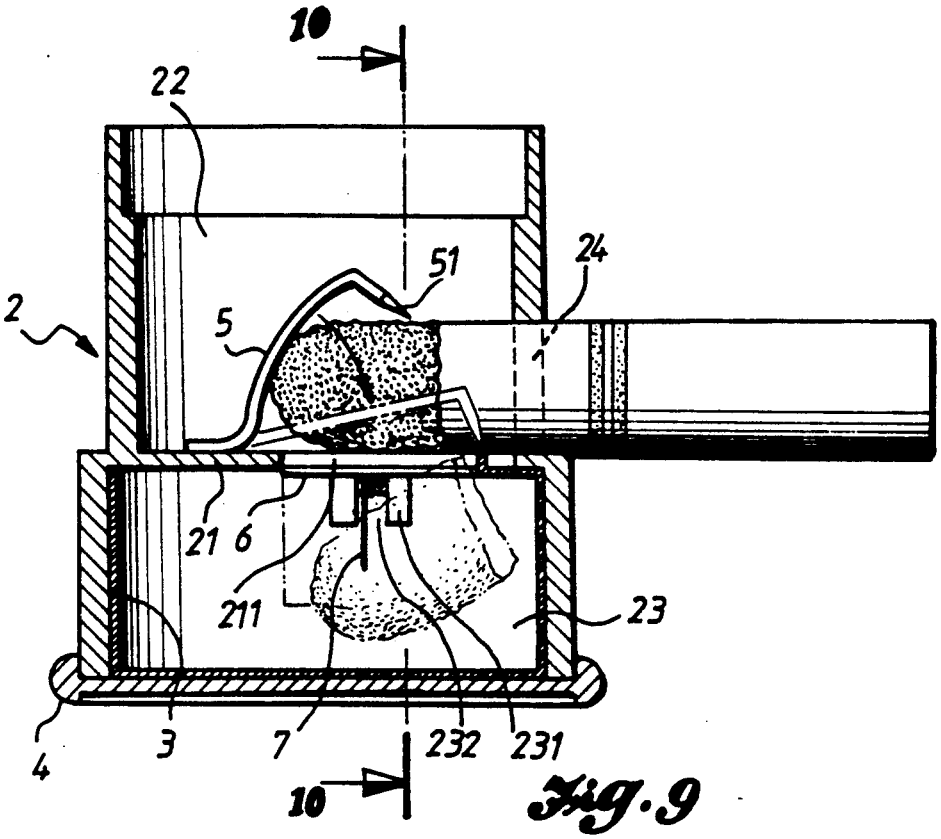
FIG. 9 is a lateral cross-section view illustrating the extinguishing of a cigarette.
Figure 10:
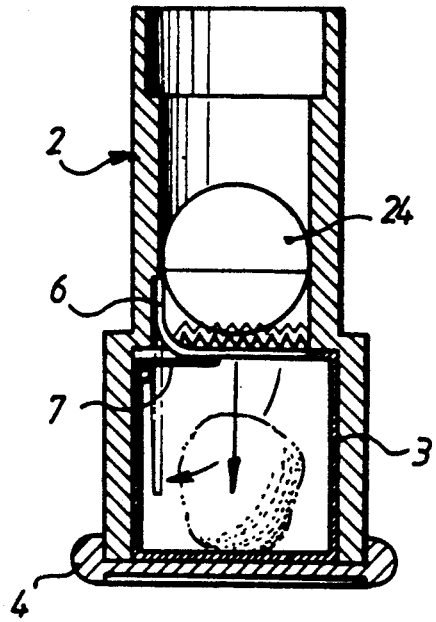
FIG. 10 is another cross-section view illustrating the extinguishing of a cigarette.

Referring to FIGS. 3, 9 and 10, the lighted portion of the cigarette is inserted into the hole 24 provided on the blocking chamber 22. At this time, the lighted cigarette contacting the sensing blade 5 as shown in FIG. 9, will cause the blade 5 to deform and cause it to become straight. This action will cause the sawtooth-like structures 51 and 31 to act toward each other to cut the lighted portion of the cigarette. This cut-off lighted portion of the cigarette will be pressed against the sensing plate 6 by the blade 5 as it stretches out, as shown in FIG. 9. When this plate 6 is heated and the temperature reaches the transition temperature, the plate 6 will rapidly deform and compress the spring 7. The sensing plate 6 is extended straight and curved downward as shown in FIG. 10. The cigarette butt is dropped into the storing chamber 3. The sensing temperature of the plate 6 is set in the range of 80° to 90° C. which is higher than that of the sensing blade 5 of 60° to 70° C. Thus a different temperature gradient is formed. When the lighted butt is extinguished, removed from the plate 6, and has fallen into the container 3, the plate 6 loses heat and restored to its original shape. When the plate 6 bends upward, the blade 5 is also bent upward. Thus, the communicating path 211 between the restoring chamber 23 and blocking chamber 22 will be sealed and thus prevent the dispersing of the cigarette ash. The bottom end of the plate 6 is provided with spring 7 urging the plate 6 to bend upward to ensure the sealing of the storing chamber 23.

The transition temperature of the blade 5 is set in the range of 60° to 80° C. and the rate of temperature increasing has been tested and shown that the temperature of 120° C. is reached within 2 sec. As a result, the cutting action can be completed within 2 seconds.

While only one embodiment of the present invention has been shown and described herein, it will be appreciated that modification may be readily made by those skilled in the art. We, therefore, intend by the appended claims to cover the modifications which fall within the true spirit and scope of the invention.

We claim:

1. An apparatus for extinguishing a lighted cigarette butt comprising (a) a hollow outer seat (2) having a bottom opening and a cover (4) for selectively covering the bottom opening of the seat (2); wherein the outer seat (2) is partitioned into an upper blocking chamber (22) and a lower storing chamber (23) by a partitioning wall (21), and a communicating path (211) is formed between the blocking chamber (22) and the storing chamber (23); a cigarette hole (24) being provided at one lateral side of the blocking chamber (22) for receiving a cigarette;

(b) a storing container (3) which is detachably secured within the interior of said hollow seat (2) through the bottom opening in said seat (c) a blade (5) which is arch-shaped and has a sawtooth-like structure (51), said blade being positioned on the partitioning wall (21), and a second sawtooth-like structure (31) being positioned across a top of said container (3); and (d) an L-shaped plate (6) being mounted on an internal wall within the blocking chamber (22) for the blocking of the communicating path (211), and a spring (7) being mounted at a position on the internal wall of said blocking chamber (22) to urge a bottom end of the L-shaped plate (6) toward a closed position; wherein said blade (5) and plate (6) are made from shape memory alloys having different temperature reaction gradients, whereby the insertion of a lighted cigarette via said hole and attendant heat created by said lighted cigarette (24) causes the blade (5) to cut the lighted portion of the cigarette and then press against plate (6) to extinguish the lighted cut-off portion of the cigarette.

2. An apparatus as set forth in claim 1, wherein an engaging edge (221) is provided along the internal wall of blocking chamber (22) for the positioning of a cigarette lighter.

3. An apparatus as set forth in claim 1, wherein the transition temperature of the blade (5) is set to a temperature in the range of 60° to 70° C.

4. An apparatus as set forth in claim 1, wherein the transition temperature of the L-shaped plate (6) is set to a temperature in the range of 80° to 90° C.

5. An apparatus as set forth in claim 1, wherein the terminal end of the blade (5) is provided with a row of sawtooth-like structures (51) facing downward and a sawtooth-like structure (31) mounted on the storing chamber (23) facing upward corresponding to said sawtooth-like structure (51).

6. An apparatus as set forth in claim 1, wherein the sawtooth-like structure (51) of the blade (5) is made of alloy steel plate being used to cut the lighted portion of a cigarette.

7. An apparatus for extinguishing a lighted cigarette butt as claimed in claim 1, wherein said blade undergoes a transition shape memory process at a predetermined temperature and said plate undergoes a transition shape memory process at a different predetermined temperature from said blade.

8. An apparatus for extinguishing a lighted cigarette butt as claimed in claim 7, wherein the predetermined transition temperature of said blade is from 60° C. to 80° C. and the predetermined transition temperature of said plate is from 80° C. to 90° C.

* * * * *